US010835807B2

(12) United States Patent
Jacobson

(10) Patent No.: US 10,835,807 B2
(45) Date of Patent: Nov. 17, 2020

(54) LIQUID COOLING SYSTEM FOR OUTDOOR SURFACES

(71) Applicant: DREAMSBIG, LLC, Iron Mountain, MI (US)

(72) Inventor: Gary Jacobson, Iron Mountain, MI (US)

(73) Assignee: DREAMSBIG, LLC, Iron Mountain, MI (US)

( * ) Notice: Subject to any disclaimer, the term of this patent is extended or adjusted under 35 U.S.C. 154(b) by 88 days.

(21) Appl. No.: 15/993,088

(22) Filed: May 30, 2018

(65) Prior Publication Data

US 2018/0353842 A1 Dec. 13, 2018

Related U.S. Application Data

(60) Provisional application No. 62/517,400, filed on Jun. 9, 2017.

(51) Int. Cl.

| | |
|---|---|
| ***A63C 19/10*** | (2006.01) |
| ***E01C 13/10*** | (2006.01) |
| ***F25C 3/00*** | (2006.01) |
| ***F25B 30/02*** | (2006.01) |

(52) U.S. Cl.

CPC ..... *A63C 19/10* (2013.01); *E01C 13/105* (2013.01); *F25C 3/00* (2013.01); *F25B 30/02* (2013.01)

(58) Field of Classification Search

CPC . A63C 19/10; F25C 3/00; F25C 30/02; E01C 13/105

See application file for complete search history.

(56) References Cited

U.S. PATENT DOCUMENTS

RE16,543 E * 2/1927 Funk et al. ..... E01C 13/105 62/235
1,634,938 A * 7/1927 Funk ..... E01C 13/105 62/75
2,878,652 A * 3/1959 Comb ..... F25C 3/02 62/235

(Continued)

FOREIGN PATENT DOCUMENTS

CA 2523423 A1 4/2007
CA 2638235 A1 2/2010

(Continued)

OTHER PUBLICATIONS

Geothermal Ice Arenas, Ice Kube Systems Ltd., West St. Paul, Canada, 2015.

(Continued)

*Primary Examiner* — Kun Kai Ma
(74) *Attorney, Agent, or Firm* — Honigman LLP

(57) ABSTRACT

A liquid cooling system for an outdoor ice forming surface provides a geothermal heat pump that has a refrigeration circuit with a compressor that is disposed between a cold tube section and a hot tube section. An outdoor structure has an upward facing ice forming surface that is configured to retain a body of ice, where a coolant line is provided at or near the ice forming surface. A fluid pump is coupled with the coolant line and is configured to circulate liquid through the coolant line and over the cold tube section of the geothermal heat pump to dispense heat before being recirculated to the ice forming surface of the outdoor structure.

20 Claims, 3 Drawing Sheets

(56) References Cited

U.S. PATENT DOCUMENTS 3,362,755 A * 1/1968 Macks ..... B65G 51/03 406/89
3,706,414 A * 12/1972 Dupre ..... F25C 3/04 239/14.2
3,751,935 A * 8/1973 MacCracken ..... F25C 3/02 62/75
3,893,507 A 7/1975 MacCracken et al.
3,910,059 A * 10/1975 MacCracken ..... E01C 13/105 62/99
5,230,218 A * 7/1993 Clulow ..... A63C 19/10 62/74
5,381,668 A * 1/1995 Morioka ..... A63C 19/10 62/235
5,850,855 A * 12/1998 Kerschbaumer ..... F16L 11/15 138/137
5,970,734 A * 10/1999 Stillwell ..... F25C 3/02 285/305
6,634,953 B1 * 10/2003 Czintos ..... A63C 19/10 104/69
7,089,753 B2 * 8/2006 Hoeks ..... F25C 3/02 62/235.1
7,250,004 B2 * 7/2007 Mollin ..... E01C 13/12 472/90
2009/0321041 A1 * 12/2009 Hammond ..... F25B 30/02 165/45
2013/0264032 A1 * 10/2013 Ahmad ..... F25C 3/04 165/104.19
2018/0179710 A1 * 6/2018 Grobinski ..... A63C 19/00

FOREIGN PATENT DOCUMENTS

EP 1283399 A1 2/2003
EP 2927624 A2 10/2015
GB 2538173 A 11/2016
JP H0599548 A 4/1993
WO WO-03008879 A2 1/2003

OTHER PUBLICATIONS

Proudfit, Theresa, Playing it cool: Refrigeration added to Pine Mountain jump tower, The Daily News, Feb. 18, 2017. URL:http://www.ironmountaindailynews.com/news/local-news/2017/02/playing-it-cool-refrigeration-added-to-pine-mountain-jump-tower/.

* cited by examiner

LIQUID COOLING SYSTEM FOR OUTDOOR SURFACES

CROSS-REFERENCE TO RELATED APPLICATION

The present application claims the filing benefit of U.S. Provisional Application, Ser. No. 62/517,400, filed Jun. 9, 2017, which is hereby incorporated herein by reference in its entirety.

TECHNICAL FIELD

This disclosure generally relates to cooling systems used to chill or freeze surfaces or structures, and more particularly to cooling systems that provide liquid cooling lines to chill or freeze surfaces, such as outdoor surface that are desired to accumulate snow or ice.

BACKGROUND

It is common to run liquid lines, such as tubing or pipes, at or below a surface of a structure or floor for purposes of heating or cooling the surface to a desired temperature, such as a temperature that is capable of chilling or freezing water or other liquids on the surface. Such a liquid cooling system is well known to form an ice surface, such as skating rinks or curling surfaces or ski jump surfaces. Other known surface cooling systems use refrigeration systems and water chillers to form ice.

SUMMARY

The present disclosure provides a liquid cooling system that uses a geothermal, forced air, heat pump unit that has a refrigeration circuit with a cold section thermally coupled with a coolant line that extends out from the geothermal heat pump unit. A portion of the coolant line is arranged at or near a cooling surface, such as a ski jump surface or other outdoor ice forming surface. The coolant line circulates a liquid, such as a mixture of water and antifreeze solution, to remove heat from the cooling surface and disperse the heat to the cold section of the refrigeration circuit, such that ice can form on the cooling surface at ambient temperatures that are above freezing. To control ambient air temperature surrounding the geothermal heat pump unit, which can help to achieve lower operating temperatures, the geothermal heat pump may be contained in a structure or enclosure that provides a temperature controlled environment, such as via the forced air portion of a geothermal heat pump unit. To also facilitate such operation, temperature sensors for monitoring various sections of the geothermal heat pump unit may be provided and control circuitry of the geothermal heat pump unit may be programmed or wired to have temperature minimum restrictions reduced or eliminated. Thus, the geothermal heat pump is operated contrary to geothermal uses of extracting heat from the ground or water and instead is configured to be used to pump the liquid to the above-ground cooling surface, such as to the ski jump, at temperatures that would otherwise freeze the ground or water surrounding buried geothermal supply lines.

According to one aspect of the present disclosure, a liquid cooling system for an outdoor ice forming surface provides a geothermal heat pump that has a refrigeration circuit with a compressor that is disposed between and generally defines a cold tube section and a hot tube section of the refrigeration circuit. The liquid cooling system also utilizes an outdoor structure that has a panel with an upward facing, ice forming surface that is configured to retain a body of ice. A coolant line is provided that has a heat absorption section disposed at or near the ice forming surface of the panel and a heat dispersion section coupled with the cold tube section of the geothermal heat pump. A fluid pump is coupled with the coolant line to pump liquid through the coolant line for the liquid to dispense heat to the cold tube section before being recirculated to the heat absorption section of the coolant line. As such, the heat absorption section is arranged to form ice at the ice forming surface of the outdoor structure.

Optionally, the outdoor structure is a ski jump that has a sloped surface covered by insulation panels to provide the upward facing ice forming surface at an inclined angle. As such, the coolant line may be divided into various sections or lines, such as an upper line disposed at an upper portion of the sloped surface and a lower line disposed at a lower portion of the sloped surface. These upper and lower lines may be coupled with a valve assembly of a single or separate geothermal heat pump units.

These and other objects, advantages, purposes, and features of the present disclosure will become apparent upon review of the following specification in conjunction with the drawings.

DETAILED DESCRIPTION

Figure 1:
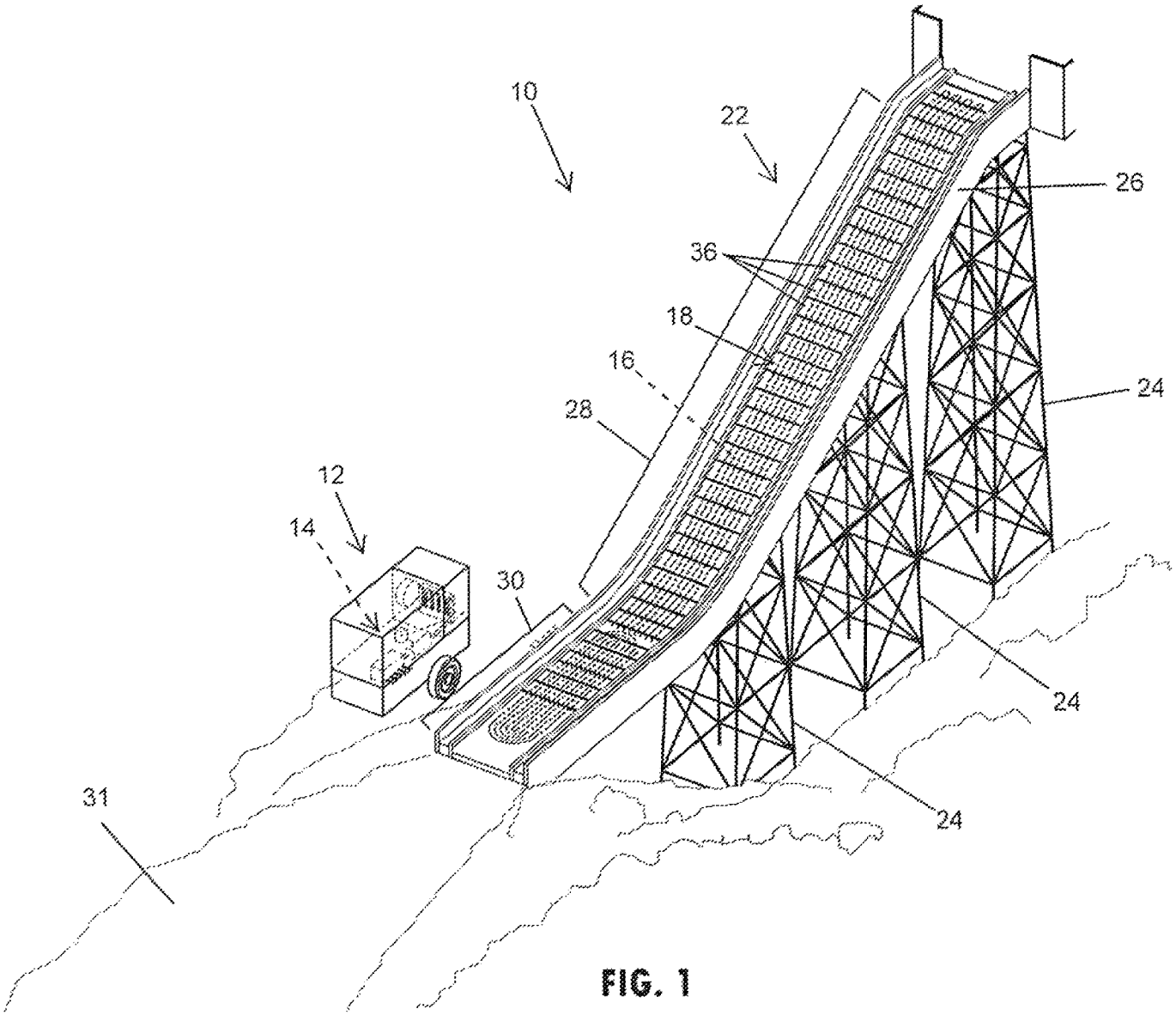
FIG. 1 is an upper perspective view of a liquid cooling system installed on a ski jump in accordance with an implementation of the present disclosure.

Referring now to the drawings and the illustrative examples depicted therein, a liquid cooling system 10 (FIG. 1) is provided that uses a geothermal heat pump unit 12 having a refrigeration circuit 14 with an evaporator or cold section 14*a* (FIG. 2) that is thermally coupled with a coolant line 16 arranged at or near a cooling surface 18 of a structure, such as a ski jump surface (FIG. 1) or other ice forming surface of an outdoor structure or related cooling applications, such as skating/ice rinks, milk tank or other dairy chillers, fish pond chillers, chemical chillers, freezers, outdoor or indoor ski or sledding hills, beer making cooling tanks, and chicken and turkey farms. The coolant line 16 circulates a liquid 20 (FIG. 3), such as a fluid mixture of water and antifreeze solution, to remove heat from the cooling surface 18 and disperse the heat to the cold section 14*a* of the refrigeration circuit 14, such that ice 32 (FIG. 3) can form on the cooling surface 18 at ambient temperatures that are above water's freezing point.

The structure installed with the liquid cooling system 10, as shown in FIG. 1, may be an outdoor structure, such as a ski jump 22 that may be erected on a hill or other sloped surface. It is also conceivable that the liquid cooling system 10 may alternatively be installed indoors or outdoors in in a variety of permanent or temporary structures, such as ice skating rinks, curling courts, ski hills, half pipe ski areas, cold environment animal exhibits, food and drink service structures, such as chilled bar tops and the like. The illustrated ski jump 22 includes scaffolding that has towers 24 supporting a sloped structure 26, which may be made of wood, cement, or other suitable structural material. It is also contemplated that the sloped structure may be constructed using the natural earth as at least part of the structure. The sloped or inclined structure 26 of the ski jump 22 has an upper surface 26*a* (FIG. 3) that includes an in-run or upper section 28 that has a large inclined angle, the greatest angle relative to other portions of the structure 26, such that the upper surface of the sloped structure 26 decreases in angle downward along the in-run 28 to form a take-off or lower section 30 of the ski jump. The take-off 30 of the ski jump 22 is arranged for a jumper or flyer to leave the upper surface 26*a* of the jump and ascend into the air and down the hill over the knoll 31 and toward a landing area. The illustrated ski jump 22 has a height of approximately 124 feet and an upper or upward-facing surface that is approximately 320 feet in length.

Figure 3:
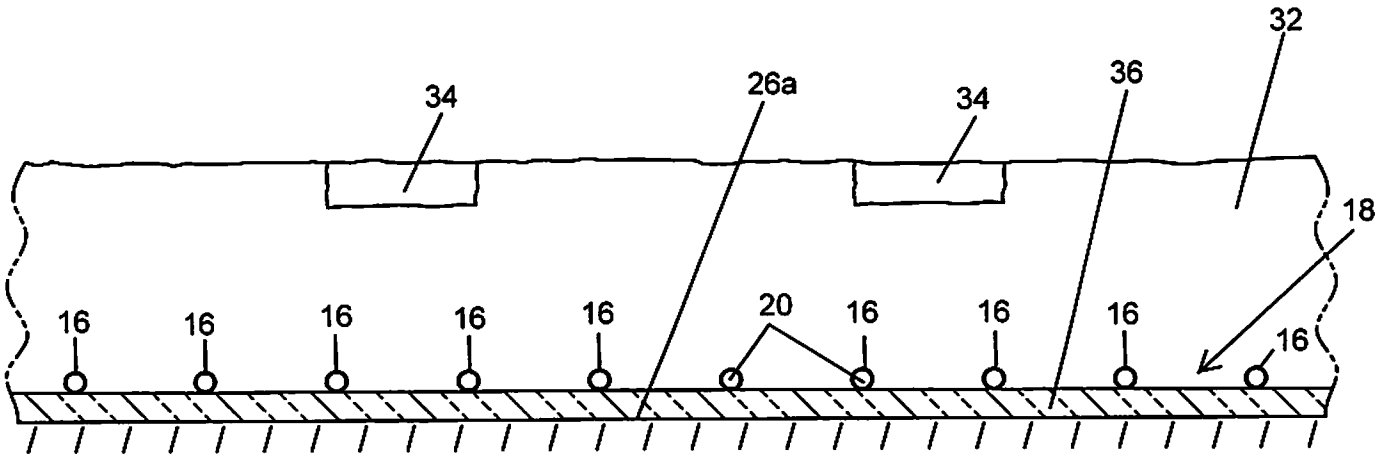
FIG. 3 is a cross-sectional view taken at line III-III of FIG. 2, showing the coolant lines disposed at an upper surface of the ski jump to form an ice layer.

To provide a slick or smooth icy surface on the ski jump, the upper surface 26*a* is typically provided with an ice and/or snow sheet or base. This ice base or structure 32, such as shown in FIG. 3, may be provided with ski channels 34 extending linearly down the jump for retaining and maintaining parallel alignment of the jumper's skis. The illustrated ice base or structure 32 is approximately 8 inches thick and weighs roughly 6,720 pounds. The consistency and strength of such an ice base or structure on the upper surface of the ski jump can be critical in providing a safe and reliable surface for ski jumping or flying. Thus, providing a consistent temperature at the ice base or structure can be desirable to prevent melt and freeze cycles that can cause uneven and unreliable surfaces.

As shown in FIG. 1, the ski jump 22 may have a series of insulation panels 36 that are arranged along the upper surface 26*a* of the structure 26, such as to provide an insulating substrate or barrier that forms an upward facing ice forming surface that is configured to support and retain the ice and/or snow structure 32. The coolant line 16 of the liquid cooling system 10 may have a heat absorption section disposed at or near the ice forming surface of the insulation panel. To efficiently absorb the heat over the ice forming surface, the coolant line 16 may be divided into various sections or separate lines. These sections and lines of the coolant line may be tubing or piping, such as a geothermal pipe comprising a polyethylene, high-density polyethylene, PVC, or CPVC or the like.

Figure 2:
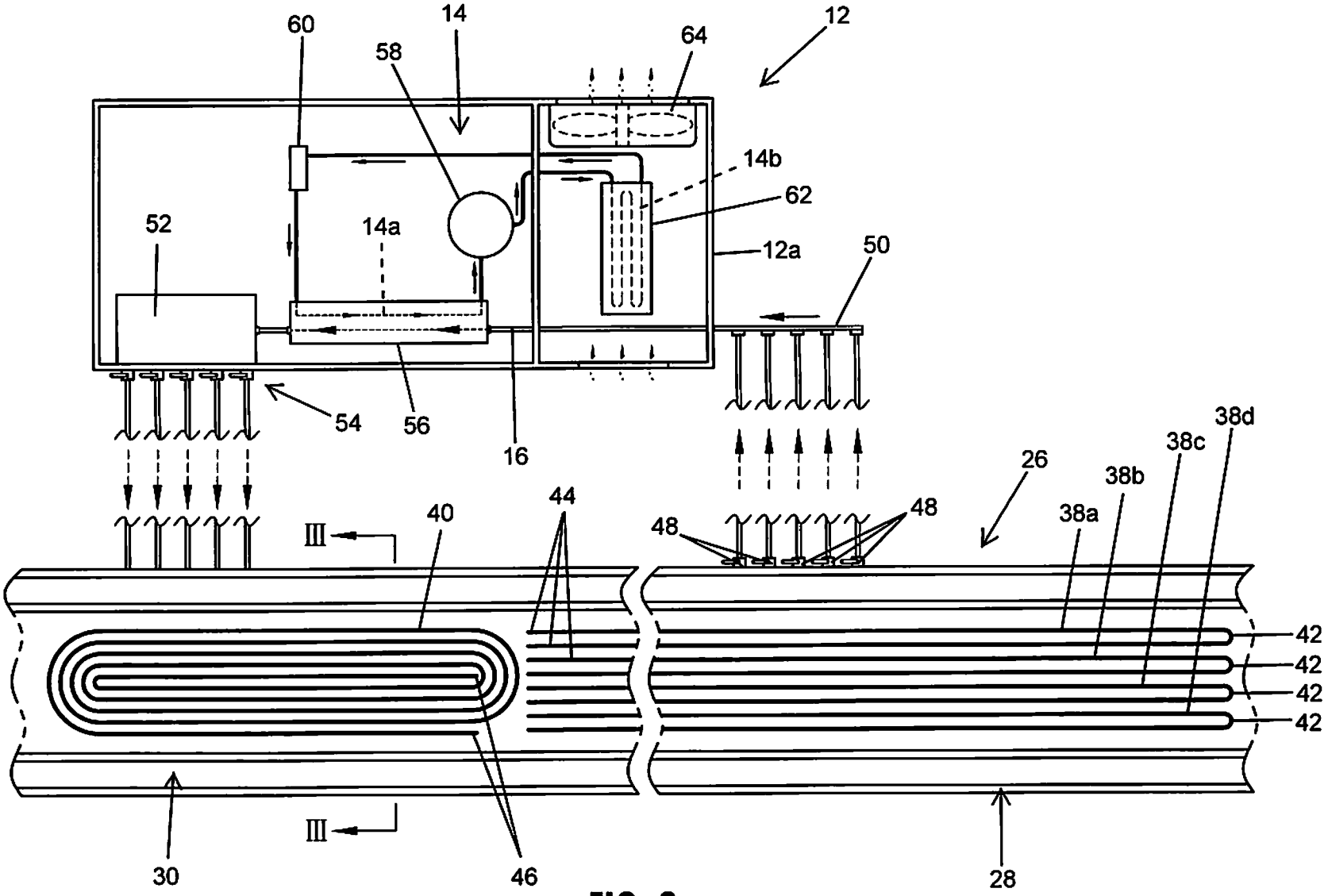
FIG. 2 is a schematic top view of the liquid cooling system shown in FIG. 1, showing coolant lines extending between the ski jump and a geothermal heat pump unit.

As shown, for example, in FIGS. 1 and 2, the coolant line 16 includes upper lines 38*a*-38*d* disposed at the upper section 28 of the sloped surface and a lower line 40 disposed at the lower section 30 of the sloped surface. The upper lines 38*a*-38*d* may be arranged generally linearly along the upper surface, such as shown in FIGS. 1 and 2 with a curved U-shaped formation 42 provided at the upper area of the in-run section 30 of the ski jumping surface. In such a formation, the ends 44 of the upper lines 38 may extend through holes in the panel structure of the jump at the lower area of the in-run section 30 to an area below or underneath the sloped panel structure to extend to the geothermal heat pump unit 12. The lower line 40 may also have ends 46 that extend through holes in the jump structure 26. The lower line 40 may be arranged in a substantially similar formation to the upper line or line, or may be arranged in an alternatively shaped formation, such as the spiral formation of the lower line 40 shown in FIGS. 1 and 2. These upper and lower lines 38, 40 may extend through holes formed through the panel structure of the jump for the lines to be coupled with one or more valve assemblies 48 that combine to a single line 50 that extends to the geothermal heat pump unit 12, such as shown in FIG. 2. It is also conceivable that the coolant line or lines may be alternatively arranged in different shapes over a ski jump from the illustrated formations.

The geothermal heat pump 12 may be contained in a structure or enclosure that provides a temperature controlled interior ambient air mass around the geothermal heat pump unit 12, as controlled ambient air temperature may be preferable for the geothermal heat pump unit 12 to achieve lower temperatures. The forced air portion of a geothermal heat pump unit 12 may be used to heat the interior ambient air mass, such as with a radiator 62 that is air cooled with a type of fan 64, such as shown in FIG. 2. Specifically, heat from the hot tube section 14*b* (FIG. 2) of the refrigeration circuit 14 may be utilized to control the interior temperature of the structure, such that the geothermal heat pump unit 12 can operate to provide desirable lower temperatures at the cold section of the coolant line. The fan 64 may be operated in conjunction with a damper system that includes one or more mechanical dampers disposed between the interior ambient air mass and an exterior air mass, such as at a wall of the structure or enclosure, such as an enclosed trailer that encloses the geothermal heat pump unit 12. The mechanical dampers may be controlled with a damper system to achieve the desired temperature at the geothermal heat pump unit 12. As shown in FIG. 1, the geothermal heat pump unit 12 is contained in an enclosed trailer so as to provide the enclosed structure explained above and also to be easily portable and located for temporary installations of the system. However, it is understood that a geothermal heat pump unit for such a system may also or alternatively be separately installed on the ground or a building foundation for temporary or permanent installations.

A fluid pump 52, as illustrated in FIG. 2, may be coupled with the coolant line 16 and configured to circulate liquid through the coolant line 16 or each individual section or line thereof. The illustrated fluid pump 52 is located within a housing 12*a* of the geothermal heat pump unit 12; however, it is contemplated that a fluid pump may also or alternatively be external to the geothermal heat pump unit. Further, the fluid pump 52 may be arranged downstream from the portion of the coolant line 16 that interfaces with the cold section 14*a* of the refrigeration circuit 14, but again, it is conceivable that a fluid pump may also or alternatively be arranged upstream from the interface with the cold section 14*a* of the refrigeration circuit 14. After exiting the fluid pump 52, the fluid may be split or divided at an exit valve assembly 54 that has several valves each connected with a single coolant line leading into the ski jump 22.

The portion of the coolant line 16 that interfaces with the cold section 14*a* of the refrigeration circuit 14 may be referred to as a heat dispersion section 56 of the coolant line 16. As shown in FIG. 2, the heat dispersion section 56 of the coolant line provides an enlarged conduit or basin for the cold tube section 14*a* of the refrigeration circuit 14 to couple with this heat dispersion section 56 by extending through the enlarged conduit or basin. In this arrangement, the fluid passing through the heat dispersion section 56 interfaces with the exterior surface of the cold tube section 14*a* to dispense or transfer heat from the fluid passing through the coolant line 16 to the cold tube section 14*a* before being recirculated to the heat absorption section that is arranged to form or maintain ice and/or snow at the ice forming surface of the outdoor structure or ski jump 22. The cold tube section 14*a* is illustrated schematically extending linearly through the heat dispersion section 56, although it is understood that this cold tube section 14*a* may be rearranged in a coiled formation or other arrangement that provides greater surface area to the heat dispersion section 56.

As generally understood, the refrigeration circuit 14 of the geothermal heat pump unit 12 may have a compressor 58 that is disposed between the cold tube section 14*a* and a hot tube section 14*b* of the refrigeration circuit. As such, the compressor 58, alone or together with an expansion valve 60 (FIG. 2), may generally define the separation between the cold tube section 14*a* and a hot tube section 14*b* of the refrigeration circuit. The refrigeration circuit 14 may be implemented in various sizes and configurations, which may operate on more or less refrigerant, such as Freon or Puron or the like. After the refrigerant passes through the evaporator or cold tube section 14*a* that may be disposed in or is thermally coupled with the heat dispersion section 56 of the coolant line 16, the refrigerant increases in temperature and may undergo a phase change to a low pressure gas as it flows to the compressor 58. The compressor 58 may then increases the pressure of the refrigerant vapor as it moves to the condenser, which is illustrated as a radiator 62 that may be air cooled with a fan 64, although it may also or alternatively be liquid cooled or the like. After the refrigerant is cooled through the radiator 62 to again change phase to a liquid, it may enter the expansion valve 60, which controls the amount of refrigerant flow back to the cold tube section 14*a* for cooling or otherwise removing heat from the interfacing portion or heat dispersion section 56 of the coolant line 16. As such, the overall liquid cooling system 10 may use substantially less refrigerant, such as approximately 3-4 lbs. of refrigerant or the like, than systems that employ a refrigeration circuit over an entire cooling area or structure, and more specifically the liquid cooling system disclosed herein may use approximately 80% less refrigerant than such other systems.

As further shown in FIG. 3, the sloped surface of the ski jump structure 26 may be covered by insulation panels 36, such as 1 inch thick foam panels, such as foam comprising polystyrene or the like, that may form the upward facing ice forming surface. The individual lines or pipes of the coolant line 16 may be attached to or arranged over the upward facing surface of the insulation panel 36, such as with brackets and/or fasteners that may also extend into and engage the ski jump structure. Thus, the coolant line 16 may be held in place on the ski jump structure for snow and/or ice to accumulate in forming the ice and/or snow base or structure 32 that may provide the channels 34 for the skis of the ski jumpers or flyers. The coolant or fluid that may be pumped or circulated through the coolant line 16 may be a mixture of water and antifreeze solution, such as a glycol or more specifically one or a combination of methanol, ethylene glycol, propylene glycol, and glycerol or the like. The coolant or fluid mixture may generally be configured to have a lower freezing point than water, so as to maintain a liquid state when being circulated through the coolant line 16.

In operation, with ambient air temperatures above freezing, the liquid cooling system 10 with a 6 ton, forced air, geothermal unit may be capable of maintaining approximately a 6 degree (Fahrenheit) temperature differential between the fluid or water mixture leaving the geothermal unit 12 and returning to the geothermal unit, after passing through approximately 3,000 feet of above-ground cooling line 16 with approximately a ¾ inch diameter. In the illustrated embodiment, the fluid or water mixture that leaves the geothermal unit 12 may be in the range of approximately 8 to 20 degrees Fahrenheit and may more preferably be at approximately 10 degrees Fahrenheit. In additional embodiments, it is conceivable that other structures installed with the system may have alternative operating parameters and desired temperature ranges.

To provide such operation, temperature sensors for monitoring various sections of the refrigeration circuit 14 and/or coolant line 16 may be located away from the coldest and hottest sections of the coolant line. Also, the control circuitry of the geothermal heat pump unit 12 may be programmed or wired to have temperature minimum restrictions reduced or eliminated to allow the unit to disperse cold fluid to the cooling line 16 arranged at or near a cooling surface 18 of a structure, as such fluid would otherwise freeze the ground and compromise the function of a traditional geothermal heating and cooling system. Thus, the geothermal heat pump unit 12 is operated contrary to typical geothermal uses and is instead used to pump the liquid to the above-ground cooling surface, such as to the ski jump 22, at temperatures that would otherwise freeze the ground surrounding the conventionally buried geothermal supply lines.

The geothermal heat pump unit 12 of the liquid cooling system 10 provides a refrigeration circuit 14 that is thermally coupled with a coolant line 16 that is provided at or near the ice forming surface of the outdoor structure. Fluid may be circulated through and within the coolant line 16 and over the cold tube section 14*a* of the geothermal heat pump unit 12 to dispense heat before being recirculated to the ice forming surface of the outdoor structure. The geothermal heat pump unit 12 in the illustrated embodiment may be used to extract heat from a frozen substance or structure and produce high temperature forced air that can be used to heat other objects or spaces, opposed to its traditional geothermal use of extracting heat from substantially constant temperature ground or bodies of water. By utilizing the geothermal heat pump unit in such a manner, it may be much more affordable to form and maintain such an ice structure in comparison to known surface cooling systems that form and maintain similar ice and/or snow structures.

For purposes of this disclosure, the terms "upper," "lower," "right," "left," "rear," "front," "vertical," "horizontal," and derivatives thereof shall relate to the orientation shown in FIG. 1. However, it is to be understood that various alternative orientations may be assumed, except where expressly specified to the contrary. It is also to be understood that the specific devices and processes illustrated in the attached drawings, and described in this specification are simply exemplary embodiments of the inventive concepts defined in the appended claims. Hence, specific dimensions and other physical characteristics relating to the embodiments disclosed herein are not to be considered as limiting, unless the claims expressly state otherwise.

Changes and modifications in the specifically described embodiments may be carried out without departing from the principles of the present disclosure, which is intended to be limited only by the scope of the appended claims as interpreted according to the principles of patent law. The disclosure has been described in an illustrative manner, and it is to be understood that the terminology which has been used is intended to be in the nature of words of description rather than of limitation. Many modifications and variations of the present disclosure are possible in light of the above teachings, and the disclosure may be practiced otherwise than as specifically described.

What is claimed is:

1. A liquid cooling system for an ice forming surface, said liquid cooling system comprising:

a geothermal heat pump unit having an electrically-powered compressor and an expansion valve that interconnects a cold tube section and a hot tube section that together form a refrigeration circuit of the geothermal heat pump unit, the electrically-powered compressor configured to circulate a refrigerant through the cold and hot tube sections of the refrigeration circuit, the geothermal heat pump unit further comprising a housing that encloses the refrigeration circuit;

a coolant line having a heat dispersion section and a heat absorption section connected together in a closed loop, the heat dispersion section extending through the housing of the geothermal heat pump unit and thermally coupled to the cold tube section of the refrigeration circuit with a liquid-to-liquid heat exchanger;

an outdoor structure having an insulation panel that includes an upward facing surface that is configured to retain a body of ice and/or snow, the heat absorption section of the coolant line disposed at the upward facing surface of the insulation panel;

a fluid pump disposed at the geothermal heat pump unit and coupled with the coolant line, the fluid pump configured to circulate a non-toxic, water-based liquid coolant through the coolant line for the non-toxic, water-based liquid coolant to dispense heat of the water-based liquid coolant from the heat dispersion section to the cold tube section of the geothermal heat pump before being circulated to absorb heat into the water-based liquid coolant from the heat absorption section that is arranged to cool the upward facing surface of the insulation panel on the outdoor structure, the non-toxic, water-based liquid coolant having a temperature in the range of 8 to 20 degrees Fahrenheit when leaving the geothermal heat pump unit; and wherein the heat absorption section of the coolant line includes (i) a first line disposed at a first portion of the upward facing surface and coupled with a first valve of a valve assembly and (ii) a second line disposed at a second portion of the upward facing surface and coupled with a second valve of the valve assembly, and wherein the valve assembly is configured to independently actuate fluid flow of the water-based liquid coolant to the first line by actuating the first valve and to the second line by actuating the second valve for independently controlling temperature at the respective first and second portions of the upward facing surface.

2. The liquid cooling system of claim 1, wherein the heat absorption section of the coolant line includes a pipe that extends linearly along the upward facing surface.

3. The liquid cooling system of claim 1, wherein the geothermal heat pump unit is contained in a structure that provides an interior ambient air around the geothermal heat pump unit, wherein the geothermal heat pump unit includes a fan that circulates the interior ambient air over the hot tube section of the refrigeration circuit to heat the interior ambient air to a desired temperature, and wherein the valve assembly is disposed in the structure containing the geothermal heat pump unit.

4. The liquid cooling system of claim 1, wherein the outdoor structure comprises a ski jump having a sloped surface covered by the insulation panel to provide the upward facing upward facing surface at an incline.

5. The liquid cooling system of claim 1, wherein the geothermal heat pump unit circulates 3-4 pounds of the refrigerant in the refrigeration circuit.

6. The liquid cooling system of claim 1, wherein the coolant line includes a pipe comprising a high-density polyethylene.

7. The liquid cooling system of claim 1, wherein the coolant line is disposed in a series of curved formations over the upward facing surface of the insulation panel.

8. A liquid cooling system for an ice forming surface, said liquid cooling system comprising:

a geothermal heat pump unit having an electrically-powered compressor and an expansion valve that interconnects a cold tube section and a hot tube section that together form a refrigeration circuit of the geothermal heat pump unit, the electrically-powered compressor configured to circulate a refrigerant through the cold and hot tube sections of the refrigeration circuit, the geothermal heat pump unit further comprising a housing that encloses the refrigeration circuit;

a coolant line having a heat dispersion section and a heat absorption section connected together in a closed loop, the heat dispersion section extending through the housing of the geothermal heat pump unit and thermally coupled to the cold tube section of the refrigeration circuit with a liquid-to-liquid heat exchanger;

a structure having an upward facing surface that is sloped at an inclined angle and configured to retain ice and/or snow, the heat absorption section of the coolant line disposed at the upward facing surface of the structure;

a fluid pump configured to pump a non-toxic, water-based liquid coolant through the coolant line to circulatory transfer heat from the heat absorption section to the cold tube section to form or maintain ice and/or snow at the upward facing surface, the non-toxic, water-based liquid coolant having a temperature in the range of 8 to 20 degrees Fahrenheit when leaving the geothermal heat pump unit; and a valve assembly comprising a plurality of valves and coupled with the coolant line, wherein the coolant line includes (i) an upper line disposed at an upper portion of the upward facing surface and coupled with a first valve of the valve assembly and (ii) a lower line disposed at a lower portion of the upward facing surface and coupled with a second valve of the valve assembly, and wherein the valve assembly is configured to independently control fluid flow of the non-toxic, water-based liquid coolant through the upper line by actuating the first valve and through the lower line by actuating the second valve to thereby independently control temperature at the respective upper and lower portions of the upward facing surface.

9. The liquid cooling system of claim 8, wherein the heat absorption section of the coolant line extends linearly along the upward facing surface.

10. The liquid cooling system of claim 8, wherein the geothermal heat pump unit is contained in an enclosure that provides an interior ambient air around the geothermal heat pump unit, and wherein the geothermal heat pump unit is configured to heat the interior ambient air from the hot tube section of the refrigeration circuit to a controlled temperature for operating the geothermal heat pump unit in a manner that provides a desired temperature at the upward facing surface.

11. The liquid cooling system of claim 8, wherein the structure comprises a ski jump having an insulation panel disposed at the upward facing surface.

12. The liquid cooling system of claim 8, wherein the geothermal heat pump unit circulates 3-4 pounds of the refrigerant in the refrigeration circuit.

13. The liquid cooling system of claim 8, wherein the coolant line includes a pipe comprising a high-density polyethylene.

14. The liquid cooling system of claim 8, wherein the coolant line is disposed in a series of curved formations over the upward facing surface.

15. A method of forming a cooled outdoor surface, said method comprising:

providing an insulation substrate at an outdoor structure to form an upward facing surface that is configured to retain ice, snow, or a combination thereof;

arranging a heat absorption section of a coolant line at the upward facing surface, wherein the heat absorption section of the coolant line includes (i) a first line disposed at a first portion of the upward facing surface and (ii) a second line disposed at a second portion of the upward facing surface;

arranging a heat dispersion section of the coolant line at a cold tube section of a geothermal heat pump unit, the heat dispersion section and the heat absorption section connected together in a closed loop, the geothermal heat pump unit having an electrically-powered compressor and an expansion valve that interconnects the cold tube section and the hot tube section that together form a refrigeration circuit of the geothermal heat pump unit, the electrically-powered compressor configured to circulate a refrigerant through the cold and hot tube sections of the refrigeration circuit, the geothermal heat pump unit further comprising a housing that encloses the refrigeration circuit; and pumping a non-toxic, water-based liquid through the coolant line to transfer heat from the heat absorption section to the cold tube section and then recirculating to the heat absorption section to cool the upward facing surface of the outdoor structure to a desired temperature, the water-based liquid having a temperature in the range of 8 to 20 degrees Fahrenheit when leaving the geothermal heat pump unit, wherein the first line is coupled with a first valve of the valve assembly and the second line is coupled with a second valve of the valve assembly, and wherein the valve assembly is configured to independently control fluid flow of the non-toxic, water-based liquid through the first line by actuating the first valve and through the second line by actuating the second valve to thereby independently control temperature at the respective first and second portions of the upward facing surface.

16. The method of claim 15, wherein the geothermal heat pump unit is contained in an enclosure that provides an interior ambient air around the geothermal heat pump unit.

17. The method of claim 16, wherein the geothermal heat pump unit includes a fan that circulates the interior ambient air over a hot tube section of the geothermal heat pump unit to heat the interior ambient air to a desired temperature.

18. The method of claim 15, wherein the outdoor structure comprises a ski jump having a sloped surface covered by the insulation substrate to arrange the upward facing surface at an inclined angle.

19. The method of claim 15, wherein the upward facing surface includes an inclined angle between the first portion and the second portion, of the upward facing surface.

20. The method of claim 19, wherein the first and second lines are each disposed in a series of curved formations over the upward facing surface.

* * * * *